US006567061B1

(12) United States Patent
Bolotski et al.

(10) Patent No.: US 6,567,061 B1
(45) Date of Patent: May 20, 2003

(54) SUBSTRATE CELL-GAP COMPENSATION APPARATUS AND METHOD

(75) Inventors: Michael Bolotski, Berkeley, CA (US); Phillip Alvelda, Oakland, CA (US)

(73) Assignee: MicroDisplay Corporation, San Pablo, CA (US)

( * ) Notice: Subject to any disclaimer, the term of this patent is extended or adjusted under 35 U.S.C. 154(b) by 0 days.

(21) Appl. No.: 09/548,052

(22) Filed: Apr. 12, 2000

Related U.S. Application Data

(60) Provisional application No. 60/129,125, filed on Apr. 13, 1999.

(51) Int. Cl.[7] ..... G09G 3/36
(52) U.S. Cl. ..... 345/89; 345/205
(58) Field of Search ..... 345/87, 88, 89, 345/98, 99, 100, 204, 205, 200, 207, 690, 691, 692, 693, 694, 697, 698, 699; 349/54, 83, 155, 120, 74

(56) References Cited

U.S. PATENT DOCUMENTS 5,402,141 A * 3/1995 Haim et al. ..... 345/88
6,061,106 A * 5/2000 Ahn et al. ..... 349/83
6,122,032 A * 9/2000 Mihara et al. ..... 349/155
6,169,590 B1 * 1/2001 Abileah et al. ..... 349/120
6,188,454 B1 * 2/2001 Greene et al. ..... 349/74

* cited by examiner

*Primary Examiner*—Xiao Wu
(74) *Attorney, Agent, or Firm*—Townsend and Twonsend and Crew LLP

(57) ABSTRACT

A method for operating a display having substrates and a plurality of capacitors formed at predetermined locations between the substrates includes measuring a capacitance for each of the plurality of capacitors, determining a cell gap for each of the plurality of capacitors in response to the capacitance for each of the plurality of capacitors, determining a cell gap relationship between the substrates in response to the cell gap for each of the plurality of capacitors and in response to the predetermined locations on the display, and determining a first intensity compensating value for a first pixel on an active region of the display in response to the cell gap relationship between the substrates and in response to a location of the first pixel on the display.

19 Claims, 4 Drawing Sheets

SUBSTRATE CELL-GAP COMPENSATION APPARATUS AND METHOD

CROSS-REFERENCES TO RELATED APPLICATIONS

This application claims priority to Provisional Application Serial No. 60/129,125 filed Apr. 13, 1999, and incorporated herein for all purposes.

BACKGROUND OF THE INVENTION

The present invention relates to inspection of display substrates. More specifically, the present invention relates to methods and apparatus for reducing the effects of non-uniform cell-gaps in displays.

Active matrix displays, passive liquid crystal displays, plasma displays; and the like are examples of flat panel displays that are commonly used for computers, televisions, monitors, watches, video cameras, PDAs, telephones, and the like. Typically, flat panel displays should appear uniform in contrast and in intensity to a viewer. For example, when all of the pixels on the display are at the maximum intensity, to a viewer, the display should appear uniform.

FIG. 1*a* illustrates an example of a display having a non-uniform intensity display in response to a uniform image. FIG. 1*b* illustrates a cross-section of the display in FIG. 1*a* having a non-uniform cell gap. FIG. 1*b* includes a first substrate 100, a second substrate 110, and gaps 120 and 130.

Non-uniform gaps (cell-gaps) between first substrate and second substrate typically cause non-uniform pixel intensities on a display. As is illustrated in FIG. 1*b*, for example, gap 120 is greater than gap 130. As a result, as illustrated in FIG. 1*a*, the display may be brighter where gap 130 is located, and darker where gap 120 is located, or vice versa.

Displays are typically tested for non-uniformity after they are fully assembled, thus, if non-uniform pixel intensities are detected, that display will most likely be discarded.

What is therefore required are methods and apparatus for reducing the number of discarded displays by compensating for variations in pixel intensity.

SUMMARY OF THE INVENTION

The present invention relates to inspection of display substrates. More specifically, the present invention relates to methods and apparatus for compensating for non-uniform output displays.

According to an embodiment a method for operating a display having substrates and a plurality of capacitors formed at predetermined locations between the substrates, includes measuring a capacitance for each of the plurality of capacitors, and determining a cell gap for each of the plurality of capacitors in response to the capacitance for each of the plurality of capacitors. The method may also include determining a cell gap relationship between the substrates in response to the cell gap for each of the plurality of capacitors and in response to the predetermined locations on the display, and determining a first intensity compensating value for a first pixel on an active region of the display in response to the cell gap relationship between the substrates and in response to a location of the first pixel on the display.

According to yet another embodiment, a display includes a pair of substrates having an active region including a plurality of pixels, a plurality of capacitors disposed at predetermined locations between the substrates, and sensors coupled to the plurality of capacitors, configured to measure capacitances of the plurality of capacitors. The display may also include a calculation unit coupled to the sensors, configured to determine a compensating value for at least one pixel of the plurality of pixels in response to the capacitances of the plurality of capacitors and in response to the predetermined locations, and an adjustment unit coupled to receive a location of the at least one pixels, coupled to receive video data for the at least one pixel, and coupled to the calculation unit, the adjustment unit configured to determine a compensated value for the at least one pixel in response to the location of the at least one pixel, the video data for the at least one pixel and to the compensating value for the at least one pixel. A driver unit coupled to the adjustment unit, configured to drive the at least one pixel in response to the compensated value for the at least one pixel is included in one embodiment.

According to yet another embodiment, a method for driving a display including a plurality of pixels includes displaying a predetermined image to the display, capturing an image of the predetermined image on the display with an acquisition unit, and comparing intensities of the predetermined image to the image of the predetermined image to form a difference image. The method may also include determining a cell gap relationship for the plurality of pixels in response to the difference image, and determining intensity compensating values for pixels on the display in response to the cell gap relationship.

Further understanding of the nature and advantages of the invention may be realized by reference to the remaining portions of the specification and drawings.

DESCRIPTION OF THE SPECIFIC EMBODIMENTS

Figure 1A:
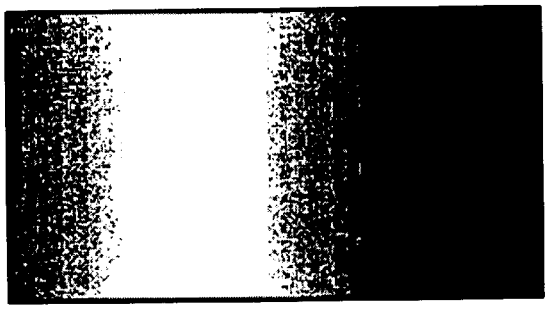
FIG. 1*a* illustrates an example of a display having a non-uniform intensity display.
Figure 1B:
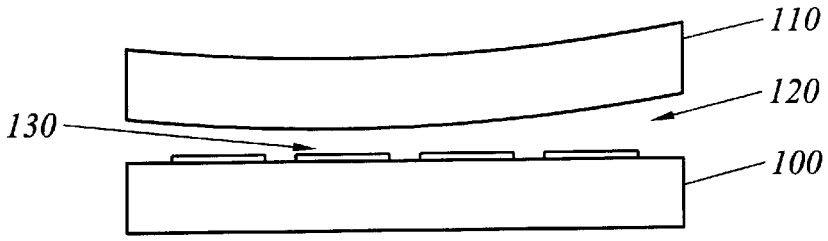
FIG. 1*b* illustrates a cross-section of the display in FIG. 1*a* having a non-uniform cell gap.
Figure 2:
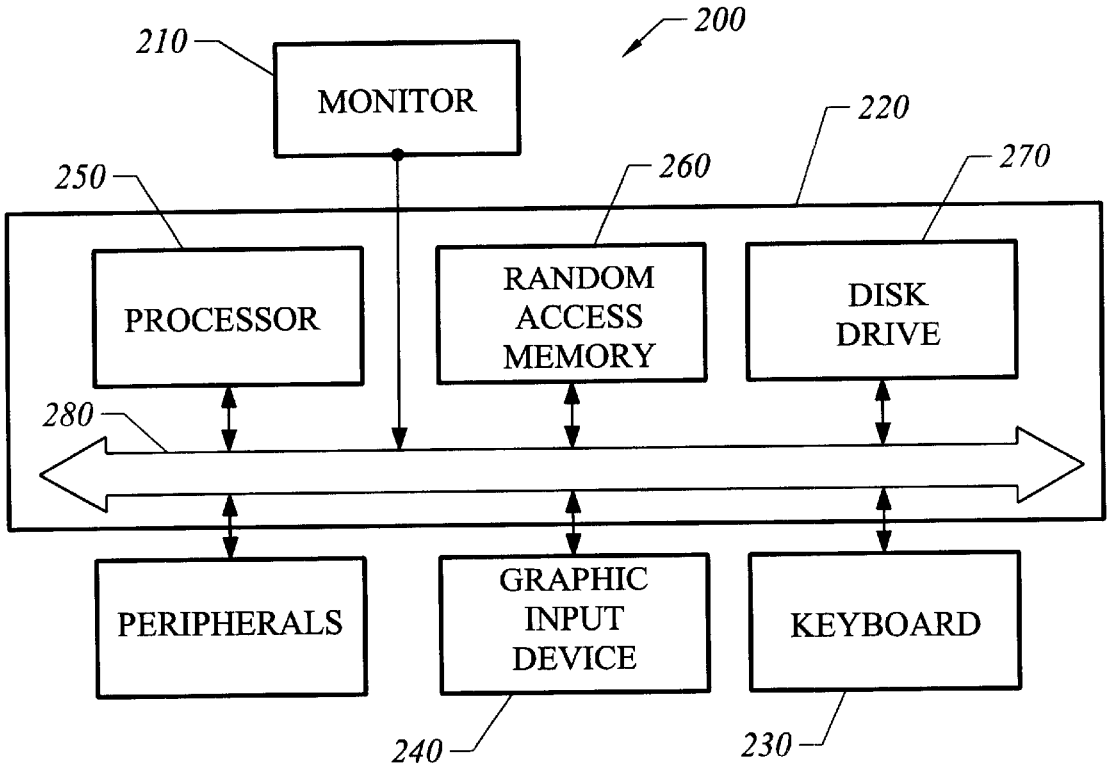
FIG. 2 illustrates a block diagram of a system according to an embodiment of the present invention.

FIG. 2 illustrates a block diagram of a system 200 according to an embodiment of the present invention. System 200 typically includes a monitor 210, a computer 220, a keyboard 230, a user input device 240. Computer 220 includes familiar computer components such as a processor 250, and memory storage devices, such as a random access memory (RAM) 260, a disk drive 270, a network interface connection, and a system bus 280 interconnecting the above components.

A mouse and a trackball are examples of pointing device 240. RAM 260 and disk drive 270 are examples of tangible media for storing computer programs and embodiments of the present invention. Other tangible media include floppy disks, removable hard disks, optical storage media such as CD-ROMS and bar codes, and semiconductor memories such as flash memories, read-only-memories (ROMS), battery-backed volatile memories, and the like.

In one embodiment, system 200 includes a 'X86 class processor such as the Athlon™ processor from AMD Corporation, running an operating system such as WindowsNT™ operating system from Microsoft Corporation, and proprietary hardware and software from MicroDisplay Corporation, the present assignee.

Figure 3:
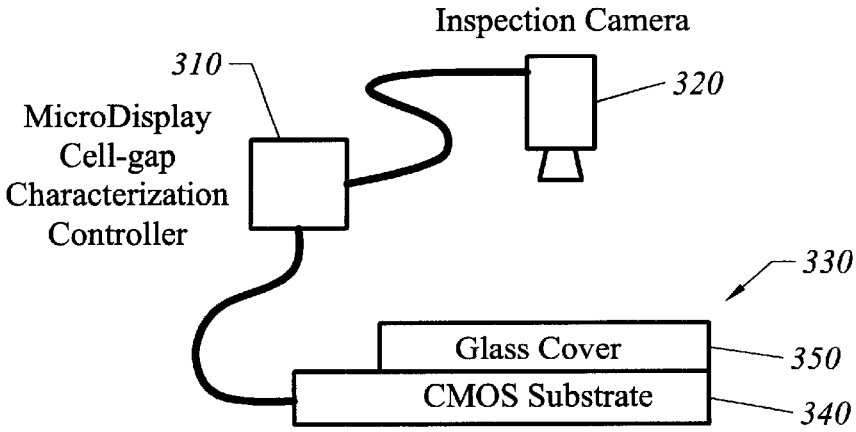
FIG. 3 illustrates another block diagram of a system according to the present invention.

FIG. 3 illustrates another block diagram of a system according to the present invention. FIG. 3 includes a system 310 including an image sensor 320. FIG. 3 also illustrates a flat panel display 330 including a first substrate 340 and a second substrate 350.

System 310 may be embodied as illustrated in FIG. 2 above. As illustrated in FIG. 3, system 310 is coupled to flat panel display 330. System 310 typically drives flat panel display 330 with predetermined values or images. Image sensor 320 is typically embodied as a high resolution CCD camera, such as a 1000×1000 pixel camera, or higher. Alternatively, other types of image sensors can be used such as linescan cameras, and the like.

Figure 4:
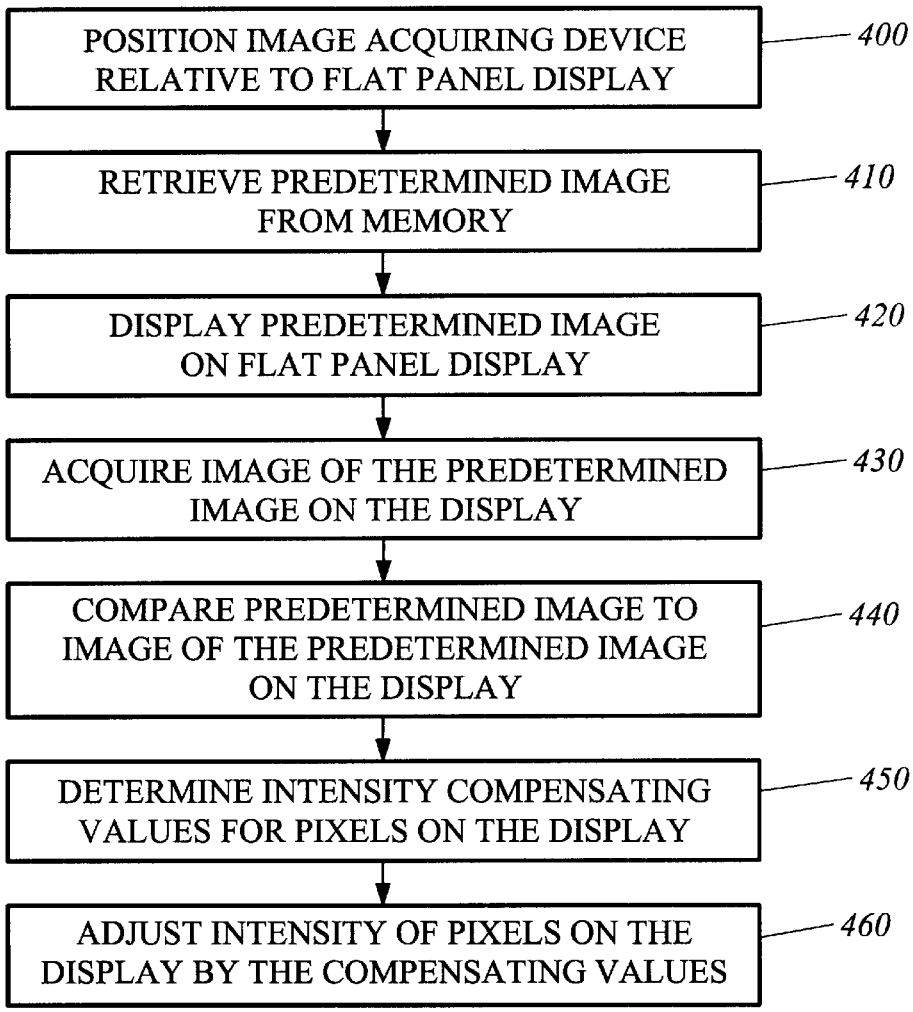
FIG. 4 illustrates a flow chart of a method for compensating for variations in pixel intensity according to an embodiment of the present invention.

FIG. 4 illustrates a flow chart of a method for compensating for variations in pixel intensity according to an embodiment of the present invention. FIG. 4 includes steps 400–460, with references to the embodiment in FIG. 3 for sake of convenience.

Initially, image sensor 320 is positioned to acquire an image of flat panel display 330, step 400. In an alternative embodiment, the image may be of a portion of flat panel display 330.

In step 410, system 310 retrieves a predetermined image from a computer readable memory. This predetermined image may be of a uniform intensity, a pattern, a particular image, etc. Alternatively, system 310 may dynamically generate the predetermined image in memory, thus reducing the need for this step. For example, system 310 may generate a "ramp" type image, or simply an image having uniform intensity.

Next, system 310 drives flat panel display 330 with the predetermined image, step 420.

While flat panel display 330 is displaying the predetermined image, image sensor 320 preferably acquires an image of the entire flat panel display 330, step 430. Typically, the image of the predetermined image on display 330 is captured in one frame time. In an embodiment, image sensor 320 is positioned relative to flat panel display 330 using a x-y stepper table. A typical x-y stepper is a Trimline manufactured by NuTec Components in N.Y., although any other conventional steppers may be used.

In alternative embodiments, image sensor 320 acquires an image of only a portion of flat panel display 350. In such embodiments, it is preferred that images covering the entire flat panel display 330 be acquired before any of the subsequent processing steps are completed. For example, if image sensor 320 captures only 25% of flat panel display 330 in a frame time, it would take at least four frame times to capture the entire flat panel display 330. In this example, more four frame times are actually required, because image sensor 320 must be repositioned relative to flat panel display 330 between image acquisitions. Typically after acquisition of the entire image post processing begins.

Next, system 310 compares the predetermined image to the predetermined image on the display, step 440. Typically, system 310 registers the images and compares the images to form a comparison image. Ideally, the pixels in the difference image would have the same intensity, indicating no difference between the predetermined image to the image of the predetermined image on the display. For a flat panel display having non-uniform intensities the difference image will include areas of pixels having non-uniform intensities.

Based upon the comparison image (or difference image), intensity compensating values for pixels on the display are determined, step 450. In this embodiment, the intensity compensating values are voltages. Next, the voltage intensities of pixels on the display (intensity) are then increased or decreased based upon the intensity compensating values, step 460.

Figure 5A:
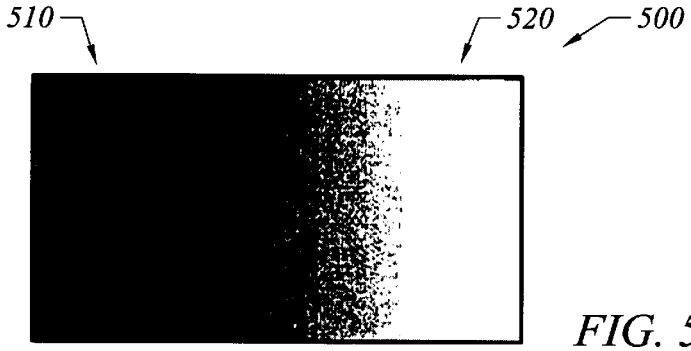
FIG. 5*a* illustrates an example of a difference image according to an embodiment of the present invention.
Figure 5B:
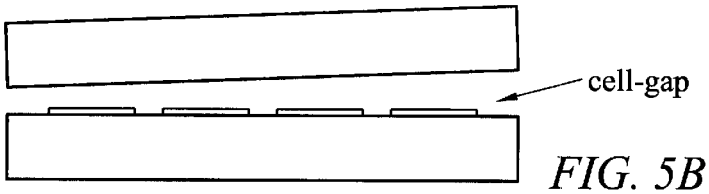
FIG. 5*b* illustrates a display having non-uniform cell gaps illustrated in FIG. 5*a;*

FIG. 5*a* illustrates an example of a difference image 500 according to an embodiment of the present invention. Difference image 500 includes a smaller difference region 510 and a larger difference region 520, brighter indicating greater difference. FIG. 5*b* illustrates a display having non-uniform cell gaps illustrated in FIG. 5*a*.

As illustrated in this example, the pixels within larger difference region 520 include larger cell gaps than pixels within smaller difference region 510. Because of this difference in cell gaps, the image is non-uniform. Thus, for example, pixels in larger difference region 520 will have larger intensity compensating values applied then pixels in smaller difference region 510. As a result, the display will appear more uniform in intensity because of the compensating values.

In the present embodiment, the compensating values are written into a memory. The memory is then incorporated into display 330. In operation, the pixels in display 330 are driven with video data. In the present embodiment, the memory is accessed and the video data is adjusted by the compensating values in the memory. Next, pixels on display 330 are driven with the video data as modified by the compensating values. These compensating values may specify a gain and/or offset for the video data. For example, in FIG. 5*a*, pixels within region 520 may have a higher gain factor than pixels within region 510. In another example, pixels within region 510 may have a higher offset compensation factor than pixels within region 520.

Figure 6:
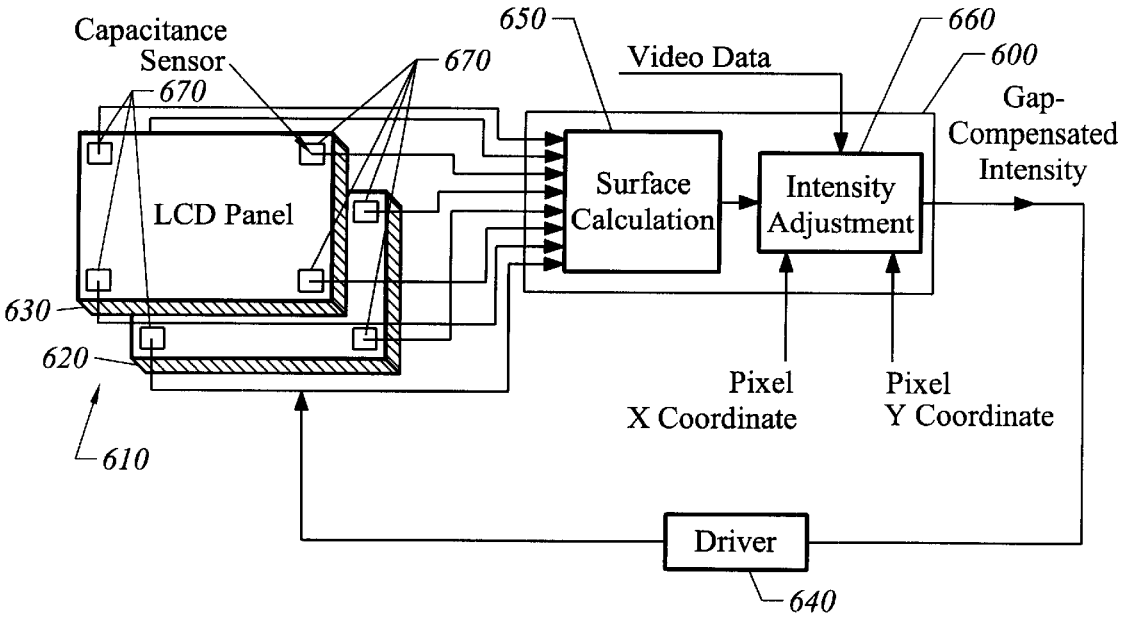
FIG. 6 illustrates a block diagram of a system according to another embodiment of the present invention.

FIG. 6 illustrates a block diagram of a system according to another embodiment of the present invention. FIG. 6 includes a system 600, a flat panel display 610 including a first substrate 620 and a second substrate 630, and a display driver 640. System 600 includes a substrate gap determining unit 650 and a intensity compensating unit 660.

As is illustrated, flat panel display 610 includes capacitors 670. Capacitors 670 include one terminal formed on first substrate 620 and the other terminal formed on second substrate 630. The capacitance of capacitors 670 depend upon the spacing between first substrate 620 and second substrate 630. Capacitors 670 are typically positioned around the perimeter of an active region of flat panel display 610. For example, as illustrated in FIG. 6, capacitors may be formed near the corners, or the like.

In the embodiment shown in FIG. 6, system 600 may be embodied as a system as illustrated in FIG. 2, above or a dedicated display micro controller. System 600 includes substrate gap determining unit 650 coupled to preferably measure the capacitances of capacitors 670. Because the x-y positional placements of capacitors 670 on flat panel display 610 are known, substrate gap determining unit 650 can estimate the cell gaps between the non-measured portions of first substrate 620 versus second substrate 630. Sensors other than capacitors can also be used to measure the cell-gaps.

In one embodiment of the present invention, assumptions are made as to the shape of the substrates. For example, in one embodiment, substrate gap determining unit 650 assumes both substrate 620 and 630 are flat. In other embodiments, unit 650 assumes a one-dimensional or two-dimensional variation in spacing.

System 600 also includes intensity compensating unit 660 coupled to substrate gap determining unit 650 and to display driver 640. Intensity compensating unit 660 receives the x-y coordinates and the intensity value of all pixels on the display. Intensity compensating unit 660 also adjusts each intensity value according to the cell gap estimate from substrate gap determining unit 650. As discussed in the embodiment above, compensating unit 660 may specify a voltage offset, a voltage gain, or the like.

In one embodiment, the functions described for intensity compensating unit 660 and substrate gap determining unit 650 may be divided differently than as described above.

Next, as shown in FIG. 6, display driver 640 receives the adjusted video data and drives flat panel display 610 with the adjusted data.

Figure 7:
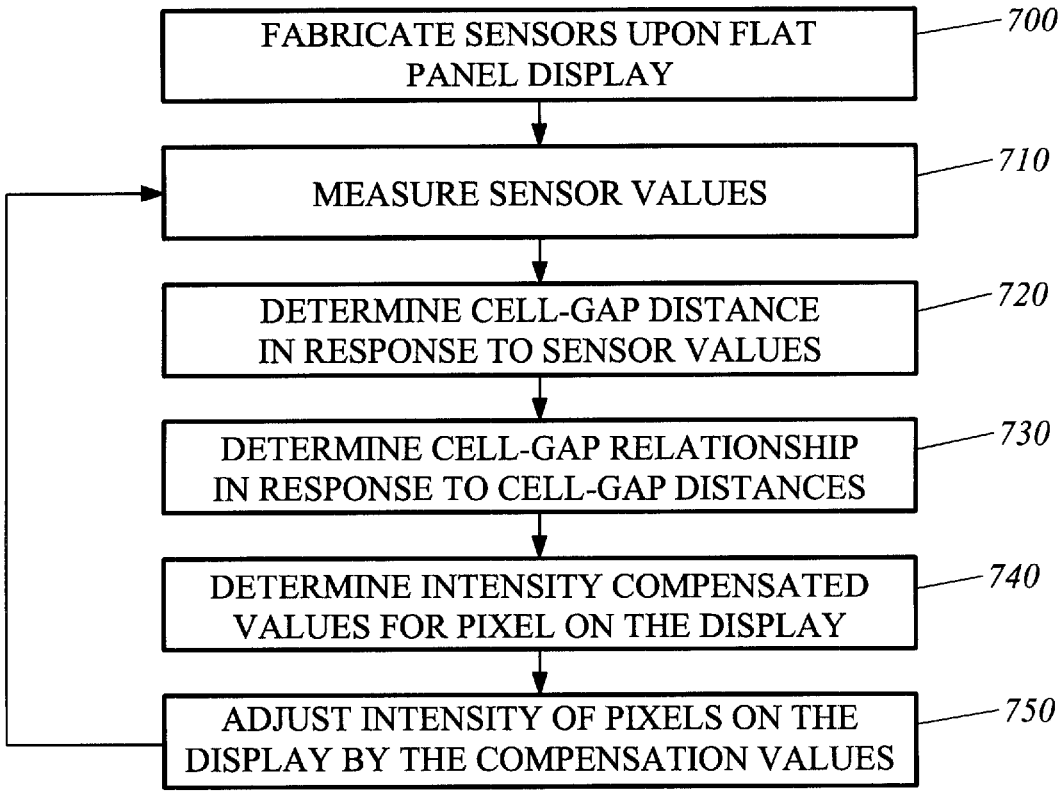
FIG. 7 illustrates a flow chart of a method for compensating for variations in pixel intensity according to an embodiment of the present invention.

FIG. 7 illustrates a flow chart of a method for compensating for variations in pixel intensity according to an embodiment of the present invention. FIG. 7 includes steps 700–750, with references to the embodiment in FIG. 6 for sake of convenience.

Initially capacitors 670 or other sensors are fabricated upon flat panel display 610, step 700. Typical locations for capacitors 670 are around the perimeter of flat panel display 610 as shown in FIG. 6. Other arrangements are illustrated in the examples below. The x-y locations of capacitors 670 are predetermined and noted.

Next, substrate gap determining unit 650 measures the capacitance for each capacitor 670, step 710. Based upon the capacitances, cell-gap distances at the location of each capacitor 670 is determined, step 720. Because the capacitance for each capacitor is inversely related to the cell-gap distance between first substrate 620 and second substrate 630, calculation of the cell-gap distances is straightforward. In an embodiment of the present invention, an external reference capacitor is provided as a reference capacitor. Based upon the reference capacitor, the distance measurements of the cell-gap distances are enhanced.

Substrate gap determining unit 650 next determines a relationship of cell-gap distances for the entire first substrate 620 relative to second substrate 630 in response to the cell-gap measurements, step 730. In one embodiment, substrate gap determining unit 650 assumes first substrate 620 is flat, and thus determines a surface equation or relationship of second substrate 630 as a function of pixel location on the display.

Other embodiments of the present invention include different algorithms for determining surface equations and include different assumptions about the shape of second substrate 630. For example, different embodiments assume second substrate 630 is flat, assume second substrate 630 is curved in only one direction, assume second substrate 630 is locally curved in two directions, etc. For example, looking at FIG. 8*a*, in one embodiment, it is assumed that all pixels along the same linear row/column into the page as capacitor C1 require the same compensating values.

Next, intensity compensating unit 660 determines the amount of intensity compensation for a pixel typically by inputting the particular pixel coordinates into the surface equation of second substrate 630, step 740. Intensity compensating unit 660 then modifies the intensity value for that particular pixel with the appropriate intensity compensation and outputs intensity compensated data to display driver 640, step 750. As discussed above, the compensation may be a gain factor, an offset factor, a combination, or the like.

The above process may be repeated anytime it is deemed necessary. For example, upon power-up of flat panel display 610, periodically when flat panel display 610 is on, before or after a screen-saver is activated, upon user request, etc.

Figure 8A:
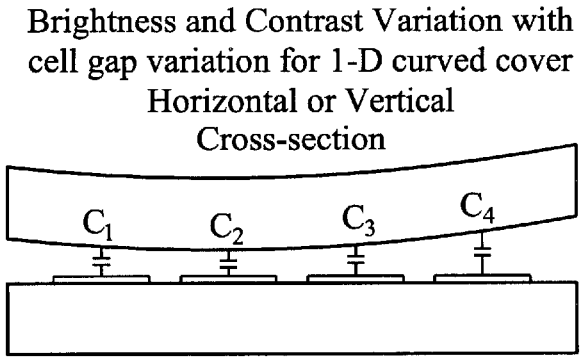
FIGS. 8*a* and 8*b* illustrates two alternative arrangements of capacitors upon a flat panel display.
Figure 8B:
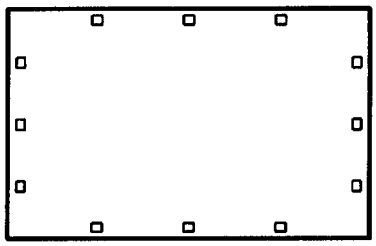

FIGS. 8*a* and 8*b* illustrate two alternative arrangements of capacitors 670 or sensors upon flat panel display 610. In one embodiment, if the assumption is made that substrates are both planes, only three capacitor are required. These three capacitances may be used to determine the differences between the planar substrates.

In the foregoing specification, the invention has been described with reference to specific exemplary embodiments thereof. Many changes or modifications are readily envisioned, such as repeating the above process for particular primary display colors. For example, activating and sensing red pixels, or blue pixels, or green pixels and using a monochromatic or a color camera to acquire images. The embodiments of the present invention may be performed on-line during fabrication or off-line by the user. In one embodiment, the capacitances of pixels may be used in place of dedicated capacitors as illustrated above. Further, other types of sensors can be used besides capacitors, such as resistors, ferro-electric elements, etc.

The presently claimed inventions may also be applied to many areas of technology such as active or passive liquid crystal displays for computers, televisions, high-definition televisions, portable digital devices, video cameras, and the like.

The specification and drawings are, accordingly, to be regarded in an illustrative rather than a restrictive sense. It will, however, be evident that various modifications and changes may be made thereunto without departing from the broader spirit and scope of the invention as set forth in the claims.

What is claimed is:

1. A method for operating a display having substrates and a plurality of capacitors formed at predetermined locations between the substrates, the method comprising:

measuring a capacitance for each of the plurality of capacitors;

determining a cell gap for each of the plurality of capacitors in response to the capacitance for each of the plurality of capacitors;

determining a cell gap relationship between the substrates in response to the cell gap for each of the plurality of capacitors and in response to the predetermined locations on the display; and determining a first intensity compensating value for a first pixel on an active region of the display in response to the cell gap relationship between the substrates and in response to a location of the first pixel on the display.

2. The method of claim 1 further comprising determining a gap compensated intensity for another pixel in response to the intensity compensating value and a video data intensity.

3. The method of claim 1 wherein the plurality of capacitors comprises at least three capacitors.

4. The method of claim 1 wherein the plurality of capacitors are disposed outside the active region of the display.

5. The method of claim 4 wherein the plurality of capacitors are disposed along one side of the active region of the display.

6. The method of claim 1 further comprising determining a second intensity compensating value for a second pixel on the display in response to the cell gap relationship between the substrates and in response to a location of the second pixel on the display, the first intensity compensating value different from the second pixel compensating value.

7. A display comprises:

a pair of substrates having an active region including a plurality of pixels;

a plurality of capacitors disposed at predetermined locations between the substrates;

sensors coupled to the plurality of capacitors, configured to measure capacitances of the plurality of capacitors;

a calculation unit coupled to the sensors, configured to determine a compensating value for at least one pixel of the plurality of pixels in response to the capacitances of the plurality of capacitors and in response to the predetermined locations;

an adjustment unit coupled to receive a location of the at least one pixels, coupled to receive video data for the at least one pixel, and coupled to the calculation unit, the adjustment unit configured to determine a compensated value for the at least one pixel in response to the location of the at least one pixel, the video data for the at least one pixel and to the compensating value for the at least one pixel; and a driver unit coupled to the adjustment unit, configured to drive the at least one pixel in response to the compensated value for the at least one pixel.

8. The display of claim 7 wherein the plurality of capacitors are disposed at locations other than at the active region.

9. The display of claim 7 wherein the plurality of capacitors comprise at least four capacitors.

10. The display of claim 7 wherein the calculation unit assumes a one-dimensional variation in the capacitances of the plurality of capacitors.

11. The display of claim 7 wherein the calculation unit assumes a two-dimensional variation in the capacitances of the plurality of capacitors.

12. The display of claim 7 wherein another pixel of the plurality of pixels and the at least one pixel are in a row of pixels on the display, and wherein a compensating value for the another pixel is equal to the compensating value for the at least one pixel.

13. The display of claim 7 wherein another pixel of the plurality of pixels and the at least one pixel are in a column of pixels on the display, and wherein a compensating value for the another pixel is equal to the compensating value for the at least one pixel.

14. The display of claim 7 wherein another pixel of the plurality of pixels and the at least one pixel are in a row of pixels on the display, and wherein a compensating value for the another pixel is different from the compensating value for the at least one pixel.

15. A method for driving a display including a plurality of pixels comprises:

displaying a predetermined image to the display;

capturing an image of the predetermined image on the display with an acquisition unit;

comparing intensities of the predetermined image to the image of the predetermined image to form a difference image;

determining a cell gap relationship for the plurality of pixels in response to the difference image; and determining intensity compensating values for pixels on the display in response to the cell gap relationship.

16. The method of claim 15 further comprising driving the pixels on the display with compensated video data in response to respective intensity compensating values and in response to respective video data for the pixels on the display.

17. The method of claim 15 wherein the predetermined image is displayed to a portion of the display.

18. The method of claim 15 wherein the predetermined image is non-uniform in intensity.

19. The method of claim 15 wherein the predetermined image is uniform in intensity.

* * * * *